US010677459B2

(12) United States Patent
Yamamoto et al.

(10) Patent No.: US 10,677,459 B2
(45) Date of Patent: Jun. 9, 2020

(54) GAS FUEL BURNER AND METHOD FOR HEATING WITH GAS FUEL BURNER

(71) Applicant: TAIYO NIPPON SANSO CORPORATION, Tokyo (JP)

(72) Inventors: Yasuyuki Yamamoto, Tokyo (JP); Kimio Iino, Tokyo (JP)

(73) Assignee: TAIYO NIPPON SANSO CORPORATION, Tokyo (JP)

( * ) Notice: Subject to any disclaimer, the term of this patent is extended or adjusted under 35 U.S.C. 154(b) by 172 days.

(21) Appl. No.: 15/552,102

(22) PCT Filed: Dec. 15, 2015

(86) PCT No.: PCT/JP2015/085032

§ 371 (c)(1),
(2) Date: Aug. 18, 2017

(87) PCT Pub. No.: WO2016/136101

PCT Pub. Date: Sep. 1, 2016

(65) Prior Publication Data

US 2018/0038590 A1 Feb. 8, 2018

(30) Foreign Application Priority Data

Feb. 27, 2015 (JP) ..... 2015-037973

(51) Int. Cl.
*F23D 14/22* (2006.01)
*F23D 14/58* (2006.01)
*F23D 14/60* (2006.01)

(52) U.S. Cl.
CPC ..... *F23D 14/22* (2013.01); *F23D 14/58* (2013.01); *F23D 14/60* (2013.01)

(58) Field of Classification Search
CPC ..... F23D 14/22; F23D 14/60; F23D 14/58
(Continued)

(56) References Cited

U.S. PATENT DOCUMENTS 3,545,903 A 12/1970 McCullough et al.
4,622,007 A * 11/1986 Gitman ..... B05B 7/0861 239/419.3

(Continued)

FOREIGN PATENT DOCUMENTS

CN 85 1 09089 1/1987
CN 1101113 4/1995

(Continued)

OTHER PUBLICATIONS

International Search Report for PCT/JP2015/085032, dated Mar. 15, 2016, 4 pages.

(Continued)

*Primary Examiner* — Steven B McAllister
*Assistant Examiner* — John E Bargero
(74) *Attorney, Agent, or Firm* — Nixon & Vanderhye P.C.

(57) ABSTRACT

The gas fuel burner of the present invention has: a first oxidation agent discharge port that is disposed in the center of a first circular face constituting a combustion chamber having a truncated cone shape that expands from the basal end toward the distal end of a burner body and that discharges a first oxidation agent in the direction that the center axis of the burner body extends; a gas fuel discharge port that is disposed on the outside of the first oxidation agent discharge port and that discharges gas fuel in a direction intersecting the direction that the center axis extends; and a second oxidation agent discharge port that is disposed on a side face of the combustion chamber and that discharges a second oxidation agent in a direction intersecting the direction that the center axis extends.

23 Claims, 4 Drawing Sheets

(58) Field of Classification Search
USPC ..... 431/12, 13
See application file for complete search history.

(56) References Cited

U.S. PATENT DOCUMENTS

| | | | | |
|---|---|---|---|---|
| 6,024,083 | A | 2/2000 | Smirnov | |
| 6,190,158 | B1 * | 2/2001 | Legiret | F23D 14/22 431/12 |
| 2007/0037106 | A1 | 2/2007 | Kobayashi et al. | |

FOREIGN PATENT DOCUMENTS

| | | |
|---|---|---|
| CN | 1715758 | 1/2006 |
| CN | 1922440 | 2/2007 |
| EP | 1 850 066 | 10/2007 |
| EP | 2 746 657 | 6/2014 |
| JP | 58-000124 | 1/1983 |
| JP | 62-500010 | 1/1987 |
| JP | 1-081437 | 5/1989 |
| JP | 4-500265 | 1/1992 |
| JP | 10-009524 | 1/1998 |
| JP | 10-073212 | 3/1998 |
| JP | 2006-017453 | 1/2006 |
| WO | WO 86/01131 | 2/1986 |
| WO | WO 90/02907 | 3/1990 |

OTHER PUBLICATIONS

Office Action issued in CN Appln. No. 201580076608.5 dated Sep. 5, 2018 w/ translation.

* cited by examiner

GAS FUEL BURNER AND METHOD FOR HEATING WITH GAS FUEL BURNER

This application is the U.S. national phase of International Application No. PCT/JP2015/085032 filed 15 Dec. 2015, which designated the U.S. and claims priority to JP Patent Application No. 2015-037973 filed 27 Feb. 2015, the entire contents of each of which are hereby incorporated by reference.

BACKGROUND OF THE INVENTION

Field of the Invention

The present invention relates to a gas fuel burner suitable for heating an object to be heated by convection heat transfer, and a method for heating with a gas fuel burner.

When heating by convection heat transfer by causing a flame formed by a gas fuel burner to directly impinge upon an object to be heated, it is required for the flame temperature to be high and the axial speed of the flame to be fast.

In the case of the object to be heated being a material that oxidizes, if there is a large amount of unreacted oxygen present when the flame impinges on the object to be heated, the problem arises of oxidation of the object to be heated being promoted.

Moreover, when performing a degreasing process with a burner flame as a pretreatment in the process of plating of cold rolled steel plate, it is necessary to perform non-water cooling of the burner.

As a gas fuel burner that heats by causing the flame to directly impinge on the object to be heated, there is the burner disclosed for example in Patent Document 1.

The burner of Patent Document 1 has a triple tube structure in which annular members are disposed concentrically, discharging from the nozzle distal end in the order of oxygen, gas fuel, and oxygen from the center in a parallel manner in the axial direction of the burner. The burner of Patent Document 1 has a structure in which the oxygen and gas fuel discharge ports are disposed on the same face.

As another mode of a gas fuel burner that heats by directly applying a flame to an object to be heated, there is the burner disclosed in Patent Document 2.

The burner disclosed in Patent Document 2 is used as an auxiliary burner for an electric furnace. The burner disclosed in Patent Document 2 has a function of heating/dissolving scrap iron by directly impinging a flame thereon, and forcefully oxidizing scrap iron with oxygen and dissolving (cutting) scrap iron by oxidation heat.

The burner disclosed in Patent Document 2 has a triple tube structure that discharges oxygen gas from the center, discharges fuel from the outer periphery of the oxygen gas, and additionally discharges oxygen gas from that outer periphery.

The burner disclosed in Patent Document 2 forms a high-speed flame by discharging the oxygen gas from the center at a high speed. In the burner disclosed in Patent Document 2, a swirl is imparted to the outermost oxygen gas to shorten the flame.

DESCRIPTION OF THE RELATED ART

[Patent Literature 1] European Patent Application No. 1850066 specification

[Patent Literature 2] Japanese Unexamined Patent Application Publication No. H10-9524

The burner disclosed in Patent Document 1 does not have a flame holding function. For this reason, when the discharge speed of the oxygen and/or the gas fuel is raised with the aim of increasing the flow speed of the flame, since blow-off of the flame occurs, it is not possible to raise the flow speed of the flame.

Since the burner disclosed in Patent Document 1 has a structure that discharges the gas fuel and oxygen in parallel, the combustion speed is retarded. Since the oxygen concentration thereby increases when impinged on an object to be heated, in the case of heating a material that easily oxidizes, the generation of oxided scale becomes a problem.

On the other hand, although the axial speed of the flame increases in the burner disclosed in Patent Document 2 due to the oxygen being discharged from the center, since cutting serves as the main function, the oxygen concentration at the center of the flame increases, leading to the problem of not being suited to the use of heating while suppressing oxidation of an object to be heated.

Therefore, the present invention has as its object to supply a gas fuel burner and a method for heating with a gas fuel burner that allows a high axial flame speed and a high temperature flame without losing combustion efficiency and that can suppress oxidation of the object to be heated and improve convection heat transfer efficiency.

SUMMARY OF THE INVENTION

The invention of the present application has the following constitution:

(1) A gas fuel burner having a burner body that extends in a predetermined direction, with a flame that heats an object to be heated formed at the distal end thereof; a combustion chamber that is disposed at the distal end of the burner body and that has a truncated cone shape that expands from the basal end toward the distal end of the burner body; a first oxidation agent discharge port that, among first and second circular faces of differing diameters that constitute the combustion chamber, is disposed in the center of the first circular face that is smaller in diameter than the second circular face and that discharges a first oxidation agent in the direction that the center axis of the burner body extends; a gas fuel discharge port that is disposed on the outside of the first oxidation agent discharge port in the first circular face, and that discharges a gas fuel in a direction intersecting the direction that the center axis of the burner body extends; and a second oxidation agent discharge port that is disposed on a side face of the combustion chamber and that discharges a second oxidation agent in a direction intersecting the direction that the center axis of the burner body extends.

(2) The gas fuel burner according to (1), comprising a third oxidation agent discharge port that is disposed more on the second circular face-side of the side face of the combustion chamber than the arrangement position of the second oxidation agent discharge port; and that discharges a third oxidation agent in a direction intersecting the direction that the center axis of the burner body extends, in which the angle formed by the direction that the center axis of the burner body extends and the discharge direction of the third oxidation agent is smaller than the angle formed by the direction that the center axis of the burner body extends and the discharge direction of the second oxidation agent.

(3) The gas fuel burner according to (1) or (2), wherein the gas fuel discharge port comprises a plurality of gas fuel discharge holes; the second oxidation agent discharge port comprises a plurality of oxygen agent discharge holes; and the plurality of gas fuel discharge holes and the plurality of oxygen agent discharge holes are disposed in concentric circles with respect to the center of the first circular face.

(4) The gas fuel burner according to any one of (1) to (3), wherein the third oxidation agent discharge port comprises a plurality of oxygen agent discharge holes; and the plurality of oxygen agent discharge holes that constitute the third oxidation agent discharge port is disposed in a concentric circle with respect to the center of the first circular face.

(5) The gas fuel burner according to any one of (1) to (4), wherein the value of the first diameter of the first circular face is made a magnitude within the range of 3 to 6 times the opening diameter of the first oxidation agent discharge port; and the value of the length of the combustion chamber in the direction that the center axis of the burner body extends is within the range of 0.5 to 2 times the first diameter.

(6) The gas fuel burner according to any one of (1) to (5), wherein the angle formed by the side face of the combustion chamber and the direction that the center axis of the burner body extends is within the range of equal to or greater than 0° and equal to or less than 20°.

(7) The gas fuel burner according to any one of (1) to (6), wherein the angle formed by the gas fuel discharge direction and the direction that the center axis of the burner body extends is within the range of equal to or greater than 0° and equal to or less than 30°.

(8) The gas fuel burner according to any one of (1) to (7), wherein the angle formed by the second oxidation agent discharge direction and the direction that the center axis of the burner body extends is within the range of equal to or greater than 10° and equal to or less than 40°.

(9) The gas fuel burner according to any one of (2) to (8), wherein the angle formed by the third oxidation agent discharge direction and the direction that the center axis of the burner body extends is within the range of equal to or greater than 5° and equal to or less than 30°.

(10) A method for heating with a gas fuel burner that heats an object to be heated using the flame formed by the gas fuel burner according to any one of (1) to (9), the method comprises: forming the flame with the discharge speed of the first oxidation agent discharged to the combustion chamber being in the range of 50 to 300 m/s, the discharge speed of the gas fuel being in the range of 20 to 100 m/s, and the discharge speed of the second oxidation agent being in the range 20 to 80 m/s; and heating the object to be heated with the flame.

(11) The method for heating with a gas fuel burner according to (10), wherein when forming the flame, the discharge speed of the third oxidation agent discharged to the combustion chamber is in the range of 20 to 80 m/s.

(12) The method for heating with a gas fuel burner according to (10) or (11), wherein the flow rate of the first oxidation agent supplied to the first oxygen agent discharge port is in the range of 40% to 90% of the total of the flow rates of all the oxidation agents supplied to the combustion chamber.

Effects of the Invention

The present invention allows a high axial flame speed and a high temperature flame without losing combustion efficiency and can suppress oxidation of the object to be heated and improve convection heat transfer efficiency.

DETAILED DESCRIPTION OF THE INVENTION

Figure 1:
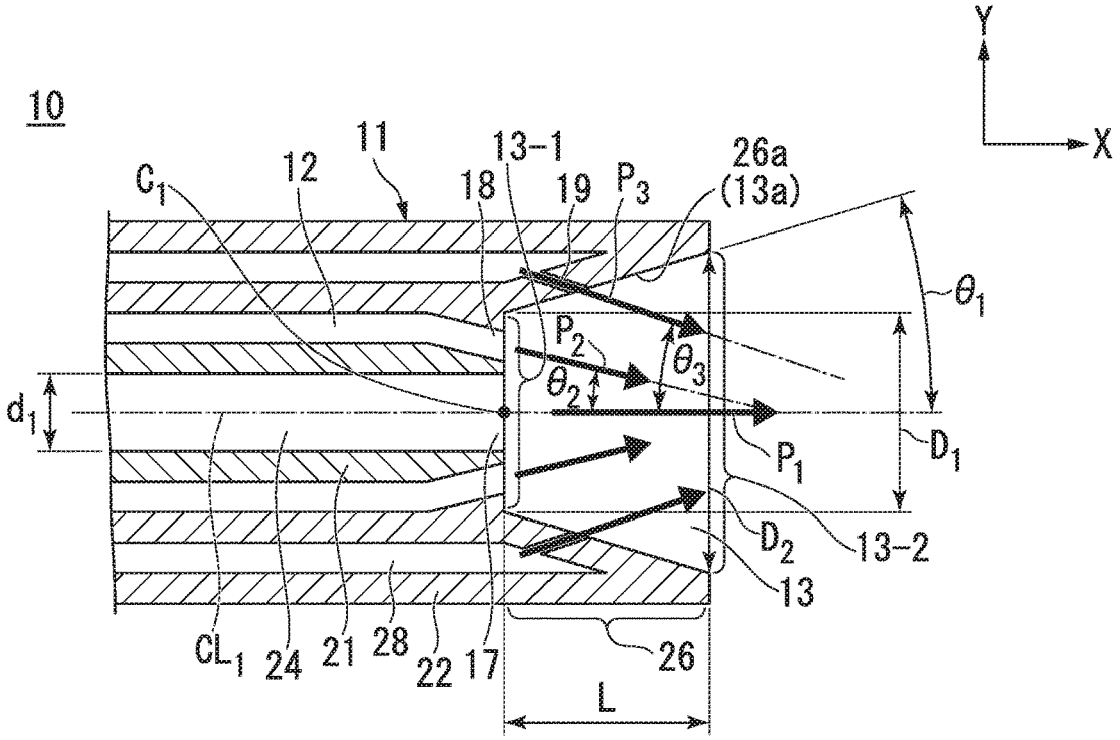
FIG. 1 is a cross-sectional view that schematically shows the outline configuration of the main portions of the gas fuel burner according to the first embodiment of the present invention.

Hereinbelow, embodiments applying the present invention are described in detail while referring to the drawings. Note that the drawings used in the following description are for describing the constitution of the embodiments of the present invention, and the size, thickness, and dimensions of the parts that are illustrated may differ from the dimensional relation of an actual gas fuel burner.

First Embodiment

FIG. 1 is a cross-sectional view that schematically shows the outline configuration of the main portions of the gas fuel burner according to the first embodiment of the present invention. In FIG. 1, the X direction denotes the direction (in other words, a predetermined direction) that the burner body 11 extends, and the Y direction denotes a direction that is orthogonal to the X direction.

Also, in FIG. 1, $P_1$ denotes the direction in which a first oxidation agent is discharged (hereinbelow called the "first oxidation agent discharge direction $P_1$"), $P_2$ denotes the direction in which a gas fuel is discharged (hereinbelow called the "gas fuel discharge direction $P_2$"), and $P_3$ denotes the direction in which a second oxidation agent is discharged (hereinbelow called the "second oxidation agent discharge direction $P_3$").

Referring to FIG. 1, a gas fuel burner 10 of the first embodiment comprises a burner body 11, a gas fuel supply path 12, a combustion chamber 13, a first oxidation agent discharge port 17, a gas fuel discharge port 18, and a second oxidation agent discharge port 19.

The burner body 11 extends in the X direction, and at the distal end thereof is formed a flame that heats an object to be heated (for example, steel or a non-ferrous metal) not illustrated. The burner body 11 comprises a first annular member 21 and a second annular member 22.

The first annular member 21 is an annular member of which the wall thickness at the distal end becomes thinner heading toward the combustion chamber 13. Thereby, the outer circumferential surface of the first annular member 21 has a tapered shape.

The first annular member 21 is disposed so that the center axis thereof agrees with the center axis $CL_1$ of the burner body 11. The first annular member 21 comprises, in inside thereof, a first oxidation agent supply path 24 that extends in the X direction therein. The shape of the first oxidation agent supply path 24 can for example be cylindrical. The first oxidation agent supply path 24 is connected to an oxidation agent supply source (not illustrated) that supplies the first oxidation agent.

The second annular member 22 is disposed on the outside of the first annular member 21 so that in the state of a gap being interposed therebetween, the center axis of the second annular member 22 agrees with the center axis $CL_1$ of the burner body 11. The inner diameter of the second annular member 22 is constituted so as to be larger than the outer diameter of the first annular member 21.

The second annular member 22 comprises a distal end portion 26 that is disposed projecting in the X direction from the distal end face of the first annular member 21.

The inner surface of the distal end portion 26 is made to be a sloping surface 26*a* (in other words, a side face 13*a* of the combustion chamber 13) so that the width of the combustion chamber 13 widens heading from the distal end face of the first annular member 21 toward the distal end face of the second annular member 22.

In the second annular member 22, the inner surface facing the tapered distal end portion of the first annular member 21 slopes in the direction toward the center axis $CL_1$ of the burner body 11.

The second annular member 22 comprises, in inside thereof, a second oxidation agent supply passage 28 that extends therein in the X direction and supplies the second oxidation agent to the distal end portion 26. The shape of the second oxidation agent supply passage 28 can for example be made cylindrical. The second oxidation agent supply passage 28 is connected with an oxidation agent supply source (not illustrated) that supplies the second oxidation agent.

The gas fuel supply path 12 is a nearly cylindrical space that is partitioned by the first annular member 21 and the second annular member 22. The gas fuel supply path 12 is connected with a gas fuel supply source (not illustrated) that supplies gas fuel.

The combustion chamber 13 is disposed at the distal end part of the burner body 11, and is demarcated by the distal end face of the first annular member 21 and the sloping surface 26*a* of the distal end portion 26 of the second annular member 22. The combustion chamber 13 is a space having a truncated cone shape that expands from the basal end (not illustrated) toward the distal end of the burner body 11 (in other words, the distal end 26 of the second annular member 22).

Thus, by providing the combustion chamber 13 to have a truncated cone shape that expands from the basal end (not illustrated) toward the distal end of the burner body 11, it is possible to inhibit spreading of the flame and increase the axial speed of the flame.

"Axial speed of the flame" here refers to the speed component in a direction parallel to the center axis $CL_1$ of the burner body 11. When the flame spreads, since the cross-sectional area of the flame increases, the axial speed of the flame falls.

Thereby, when a flame is impinged on an object to be heated for heating thereof, since the convective heat transfer coefficient (heat transfer amount per unit area, per unit time, per unit temperature differential (temperature differential between the object to be heated and the flame)) increases the faster the axial speed of the flame that is impinged, it is possible to increase the heat transfer efficiency.

The combustion chamber 13 has a first circular face 13-1 disposed in the interior of the burner body 11 and a second circular face 13-2 disposed on the same plane as the distal end face of the gas fuel burner 10.

The first and second circular faces 13-1, 13-2 are circular faces in which the first diameter $D_1$ and the second diameter $D_2$ differ, and are disposed oppositely in the X direction. The first diameter $D_1$ of the first circular face 13-1 is constituted to be smaller than the second diameter $D_2$ of the second circular face 13-2.

The value of the first diameter $D_1$ of the first circular face 13-1 should be made, for example, a magnitude within the range of three to six times the value of the opening diameter $d_1$ of the first oxidation agent discharge port 17.

When the ratio of the first diameter $D_1$ to the opening diameter $d_1$ is less than 3, the flame more easily makes contact with the sloping surface 26*a* of the distal end portion 26 that demarcates the side face 13*a* of the combustion chamber 13, and since the distal end portion of the burner body 11 becomes heated by the flame, the distal end portion of the burner body 11 is damaged. For this reason, it becomes necessary to provide a cooling water circulation passage that circulates cooling water for cooling the distal end portion of the burner body 11 at the distal end portion of the burner body 11.

On the other hand, when the ratio of the first diameter $D_1$ to the opening diameter $d_1$ is greater than 6, since the function of the combustion chamber 13 as a combustion chamber is degraded, and the axial flame speed is retarded, the convection heat transfer effect deteriorates.

Accordingly, by making the value of the first diameter $D_1$ of the first circular face 13-1 a magnitude within the range of three to six times the value of the opening diameter $d_1$ of the first oxidation agent discharge port, it is possible to inhibit damage to the distal end portion of the burner body 11 and possible to inhibit deterioration in the convection heat transfer effect without providing a cooling water circulation passage.

The value of the length L of the combustion chamber 13 in the direction (X direction) that the center axis $CL_1$ of the burner body 11 extends should for example be within the range of 0.5 to 2 times the value of the first diameter $D_1$.

When the value of the length L of the combustion chamber 13 in the direction that the center axis $CL_1$ of the burner body 11 extends is less than 0.5 times the value of the first diameter $D_1$, the effect of inhibiting the spread of the flame is diminished.

On the other hand, when the value of the length L of the combustion chamber 13 in the direction that the center axis $CL_1$ of the burner body 11 extends is greater than two times the value of the first diameter $D_1$, the flame makes contact with the side face 13*a* of the combustion chamber 13, and so there is a risk of damage.

Accordingly, by making the value of the length L of the combustion chamber 13 in the direction (X direction) that the center axis $CL_1$ of the burner body 11 extends in the range of 0.5 to 2 times the value of the first diameter $D_1$, it is possible to inhibit the spread of the flame, and it is possible to increase the axial flame speed.

The angle $\theta_1$ formed by the side face 13*a* of the combustion chamber 13 (in other words the sloping surface 26*a*) and the direction (X direction) that the center axis $CL_1$ of the burner body 11 extends should be set in the range of for example equal to or greater than 0° and equal to or less than 20°.

When the angle $\theta_1$ formed by the side face 13*a* of the combustion chamber 13 and the direction that the center axis $CL_1$ of the burner body 11 extends is less than 0°, since it is not possible to form the shape of the combustion chamber 13 in the truncated cone shape as shown in FIG. 1, the flame makes contact with the combustion chamber 13, leading to the risk of damage.

On the other hand, when the angle θ formed by the side face 13*a* of the combustion chamber 13 and the direction that the center axis $CL_1$ of the burner body 11 extends is greater than 20°, the effect of inhibiting the spread of the flame is diminished.

Accordingly, by setting the angle $\theta_1$ formed by the side face 13*a* of the combustion chamber 13 and the direction that the center axis $CL_1$ of the burner body 11 extends in the range of equal to or greater than 0° and equal to or less than 20°, it is possible to inhibit melting to the burner body 11 constituting the combustion chamber 13 and possible to inhibit spreading of the flame The first oxidation agent discharge port 17 is disposed in the center of the first circular face 13-1, and is integrally constituted with the first oxidation agent supply path 24.

The first oxidation agent discharge port 17 discharges the first oxidation agent (for example, pure oxygen, oxygen-enriched air, or the like) conveyed by the first oxidation agent supply path 24 in the X direction (in other words, the direction of the center axis $CL_1$ of the burner body 11).

The discharge speed of the first oxidation agent discharged to the combustion chamber 13 can be appropriately set in a range of for example 50 to 300 m/s.

The opening diameter $d_1$ of the first oxidation agent discharge port 17 can be set to be nearly equivalent to for example the diameter of the first oxidation agent supply path 24.

Also, since it is possible to maintain the axial speed (in other words, the speed in the direction of the center axis $CL_1$ of the burner body 11) of the first oxidation agent that is discharged until a distant position spaced apart from the combustion chamber 13 by constituting the first oxidation agent discharge port 17 with one discharge hole, it is possible to improve the convection heat transfer efficiency.

The flow rate of the first oxidation agent supplied to the first oxidation agent discharge port 17 should be set to a range of for example 40% to 90% of the total of the flow rates of all the oxidation agents supplied to the combustion chamber 13 (in the case of the first embodiment, the total of the first oxidation agent flow rate and the second oxidation agent flow rate).

When the flow rate of the first oxidation agent supplied to the first oxidation agent discharge port 17 is less than 40% of the total of the flow rates of all the oxidation agents supplied to the combustion chamber 13, the axial flame speed falls, leading to a drop in the convection heat transfer efficiency. In this case, since the flame spreads within the combustion chamber 13, the distal end portion of the burner body 11 is heated, leading to a risk of damage.

Accordingly, in order to inhibit damage to the distal end portion of the burner body 11 in this case, the necessity arises to separately provide a water cooling mechanism that can cool the distal end portion of the burner body 11.

On the other hand, when the flow rate of the first oxidation agent supplied to the first oxidation agent discharge port 17 exceeds 90% of the total of the flow rates of all the oxidation agents supplied to the combustion chamber 13, since the flow rate of the second oxidation agent becomes excessively low, the flame retaining effect is degraded, and the mixing degree of the gas fuel and the oxidation agents worsens, leading to difficulty in obtaining a practical flame.

In this case, since the combustibility worsens, a flame with high residual oxygen is formed. Thereby, when heating an object to be heated that oxidizes, the object to be heated is oxidized.

Accordingly, by keeping the flow rate of the first oxidation agent supplied to the first oxidation agent discharge port 17 within the range of 40% to 90% of the total of the flow rates of all the oxidation agents supplied to the combustion chamber 13, it is possible to inhibit damage to the distal end portion of the burner body 11 without separately providing a water cooling mechanism, and it is possible to inhibit oxidation of the object to be heated even when the object to be heated is a material that is easily oxidized.

The gas fuel discharge port 18 is provided between the sloped portion of the distal end portion of the first annular member 21 and the second annular member 22 that faces the sloped portion in the Y direction.

Thereby, the gas fuel discharge port 18 is disposed on the outside of the first oxidation agent discharge port 17 in the first circular face 13-1.

The gas fuel discharge port 18 is constituted by a plurality of gas fuel discharge holes (not illustrated). The plurality of gas fuel discharge holes (not illustrated) are disposed in a concentric circle with respect to the center $C_1$ of the first circular face 13-1. The gas fuel discharge port 18 discharges gas fuel (for example, natural gas, town gas, LPG (Liquefied Petroleum Gas) and the like) in a direction intersecting the direction that the center axis $CL_1$ of the burner body 11 extends. The discharge speed of the gas fuel that is discharged from the gas fuel discharge port 18 can be suitably selected in the range of for example 20 to 100 m/s.

The angle $\theta_2$ formed by the gas fuel discharge direction $P_2$ and the direction that the center axis $CL_1$ of the burner body 11 extends should be set within the range of for example equal to or greater than 0° and equal to or less than 30°.

By setting the angle $\theta_2$ formed by the gas fuel discharge direction $P_2$ and the direction that the center axis $CL_1$ of the burner body 11 extends within the range of equal to or greater than 0° and equal to or less than 30° in this way, it is possible to accelerate the mixing of the gas fuel and the first oxidation agent.

The gas fuel burner 10 of the first embodiment comprises the first oxidation agent discharge port 17 that is constituted by a single hole that discharges the first oxidation agent in the direction of the center axis $CL_1$ of the burner body 11 and the gas fuel discharge port 18 that is disposed so as to enclose the first oxidation agent discharge port 17 and that discharges gas fuel in a direction intersecting the direction that the center axis $CL_1$ of the burner body 11 extends. With such a constitution, since the first oxidation agent that is discharged at a high speed entrains the gas fuel discharged from around the first oxidation agent discharge port and, as a result, the mixture of the gas fuel and the first oxidation agent combusts, it is possible to form a flame with a fast axial speed.

The second oxidation agent discharge port 19 is provided so as to penetrate the distal end portion 26 constituting the side face 13*a* of the combustion chamber 13. The second oxidation agent discharge port 19 discharges the second oxidation agent (for example, pure oxygen, oxygen-enriched air, or the like) in a direction intersecting the direction that the center axis $CL_1$ of the burner body 11 extends.

The second oxidation agent discharge port 19 comprises a plurality of oxidation agent discharge ports. The plurality of oxidation agent discharge ports constituting the second oxidation agent discharge port 19 are disposed in a concentric circle with respect to the center $C_1$ of the first circular face 13-1.

If the discharge speed of the first oxidation agent discharged to the combustion chamber 13 is 50 to 300 m/s, and the discharge speed of the gas fuel is 20 to 100 m/s, the discharge speed of the second oxidation agent can be appropriately selected in the range of for example 20 to 80 m/s.

By setting the discharge speed of the first oxidation agent, the discharge speed of the gas fuel, and the discharge speed of the second oxidation agent in the aforementioned numerical ranges, it is possible to form a flame with a high combustion efficiency and a fast axial speed.

The angle $\theta_3$ formed by the second oxidation agent discharge direction $P_3$ and the direction that the center axis $CL_1$ of the burner body 11 extends should be set in the range of for example equal to or greater than 10° and equal to or less than 40°.

When the angle $\theta_3$ formed by the second oxidation agent discharge direction $P_3$ and the direction that the center axis $CL_1$ of the burner body 11 extends is less than 10°, due to the mixing of the gas fuel and the second oxidation agent worsening, the combustion efficiency falls.

When the angle $\theta_3$ formed by the second oxidation agent discharge direction $P_3$ and the direction that the center axis $CL_1$ of the burner body 11 extends is greater than 40°, the flow of the first oxidation agent and the flow of the gas fuel is shielded, leading to the axial speed of the flame being retarded.

Accordingly, by setting the angle $\theta_3$ formed by the second oxidation agent discharge direction $P_3$ and the direction that the center axis $CL_1$ of the burner body 11 extends in the range of equal to or greater than 10° and equal to or less than 40°, due to the gas fuel being enclosed by the second oxidation agent, it is possible to suppress deviation of the gas fuel, and the mixing of the gas fuel and the second oxidation agent is accelerated, and since the combustion is completed earlier, it is possible to form a short flame with a high temperature.

Thereby, when heating an object to be heated that easily oxidizes by impinging a flame thereon, it is possible to efficiently transmit heat to the object to be heated while inhibiting oxidation of the object to be heated.

Since it is possible to inhibit the flow of the flame along the inner wall of the distal end portion of the burner body 11 by providing the second oxidation agent discharge port 19, which penetrates the distal end portion 26 constituting the side face 13*a* of the combustion chamber 13, it is possible to suppress damage to the burner body 11.

The gas fuel burner of the first embodiment comprises the burner body 11 that extends in the X direction and in which a flame that heats an object to be heated (not illustrated) is formed at the distal end thereof the combustion chamber 13 that is disposed at the distal end portion of the burner body 11 and that has a truncated cone shape that expands from the basal end toward the distal end of the burner body 11; the first oxidation agent discharge port 17 that, of the first and second circular faces 13-1, 13-2 with differing diameters constituting the combustion chamber 13, is disposed in the center $C_1$ of the first circular face 13-1 which is smaller in diameter than the second circular face 13-2 and that discharges the first oxidation agent in the direction that the center axis $CL_1$ of the burner body 11 extends; and the gas fuel discharge port 18 that is disposed on the outside of the first oxidation agent discharge port 17 in the first circular face 13-1 and that discharges the gas fuel in a direction intersecting the direction that the center axis $CL_1$ of the burner body 11 extends. With such a constitution, it is possible to form a flame with a fast axial speed since the first oxidation agent, which is discharged at a high speed, combusts while entraining the gas fuel that is discharged from the periphery thereof.

The gas fuel burner of the first embodiment can further comprise the second oxidation agent discharge port 19 that is disposed on the side face 13*a* of the combustion chamber 13 and that discharges the second oxidation agent in a direction intersecting the direction that the center axis $CL_1$ of the burner body 11 extends. By adopting this constitution, due to the gas fuel discharged from the gas fuel discharge port being enclosed by the second oxidation agent discharged from the second oxidation agent discharge port, it is possible to inhibit deviation of the gas fuel, and in addition mixing between the gas fuel and the second oxidation agent in the combustion chamber 13 is accelerated, and since it is possible to complete the combustion earlier, it is possible to form a short flame with a high temperature.

Thereby, in the case of heating an object to be heated that is easily oxidized by impinging a flame thereon, it is possible efficiently transfer heat to the object to be heated while inhibiting oxidation of the object to be heated.

That is, the gas fuel burner of the first embodiment can obtain a flame with a high axial speed and a high temperature without losing combustion efficiency and can suppress oxidation of the object to be heated and improve convection heat transfer efficiency.

In a method for heating with a gas fuel burner that heats an object to be heated using the flame formed by the aforementioned gas fuel burner 10, the object to be heated with the flame may be heated with the flame having the discharge speed of the first oxidation agent discharged to the combustion chamber 13 being in the range of 50 to 300 m/s, the discharge speed of the gas fuel being in the range of 20 to 100 m/s, and the discharge speed of the second oxidation agent being in the range of 20 to 80 m/s.

By performing the method for heating with a gas fuel burner using such conditions, the mixing of the gas fuel and the second oxidation agent in the combustion chamber 13 is accelerated, and since it is possible to complete the combustion earlier, it is possible to form a short flame with a high temperature.

In the method for heating with a gas fuel burner of the present invention, as described previously regarding the gas fuel burner of the invention of the present application, the flow rate of the first oxidation agent supplied to the first oxidation agent discharge port 17 should be set in a range of 40% to 90% of the total of the flow rates of all the oxidation agents supplied to the combustion chamber 13.

Thereby, it is possible to inhibit damage to the distal end portion of the burner body 11 without separately providing a water cooling mechanism, and it is possible to inhibit oxidation of the object to be heated even when the object to be heated is a material that is easily oxidized.

Second Embodiment

Figure 2:
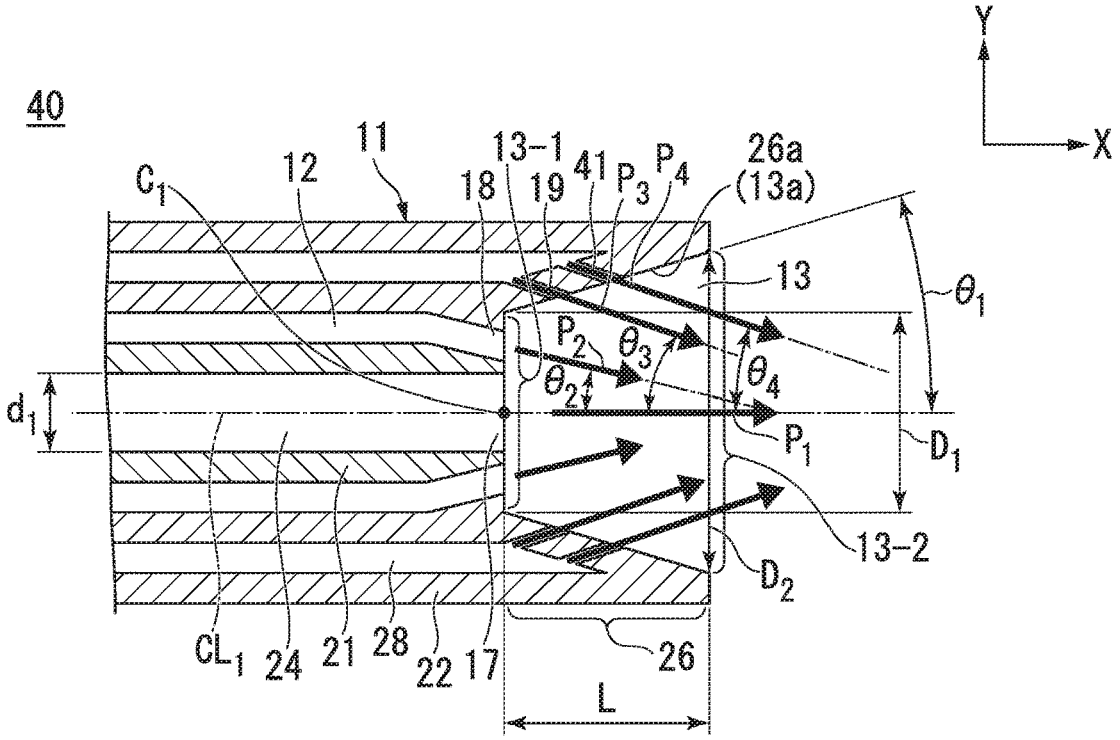
FIG. 2 is a cross-sectional view that schematically shows the outline configuration of the main portions of the gas fuel burner according to the second embodiment of the present invention.

FIG. 2 is a cross-sectional view that schematically shows the outline configuration of the main portions of the gas fuel burner according to the second embodiment of the present invention. In FIG. 2, $P_4$ denotes the direction in which a third oxidation agent is discharged (hereinbelow referred to as the "third oxidation agent discharge direction $P_4$").

In FIG. 2, constituent portions that are the same as those of the gas fuel burner 10 of the first embodiment shown in FIG. 1 are denoted by the same reference numerals.

The gas fuel burner 40 of the second embodiment shown in FIG. 2 is constituted similarly to the gas fuel burner 10 of the first embodiment, except for a third oxidation agent discharge port 41 being additionally provided in the constitution of the gas fuel burner 10 of the first embodiment.

The third oxidation agent discharge port 41 in the gas fuel burner 40 of the second embodiment is disposed more toward the second circular face 13-2 side of the side face 13*a* of the combustion chamber 13 than the arrangement position of the second oxidation agent discharge port 19.

The third oxidation agent discharge port 41 comprises a plurality of oxidation agent discharge holes (not illustrated). The plurality of oxidation agent discharge holes constituting the third oxidation agent discharge port 41 are disposed in a concentric circle with respect to the center $C_1$ of the first circular face 13-1.

Moreover, the third oxidation agent discharge port 41 discharges the third oxidation agent in a direction intersecting the direction that the center axis $CL_1$ of the burner body 11 extends (that is, the third oxidation agent discharge direction $P_4$).

The angle $\theta_4$ formed by the direction that the center axis $CL_1$ of the burner body 11 extends and the third oxidation agent discharge direction $P_4$ is constituted so as to be smaller than the angle $\theta_3$ formed by the direction that the center axis $CL_1$ of the burner body 11 extends and the second oxidation agent discharge direction $P_3$.

By making the angle $\theta_4$ formed by the direction that the center axis $CL_1$ of the burner body 11 extends and the third oxidation agent discharge direction $P_4$ smaller than the angle $\theta_3$ formed by the direction that the center axis $CL_1$ of the burner body 11 extends and the second oxidation agent discharge direction $P_3$, the gas fuel burner 40 of the second embodiment can inhibit the spread of the flame without hindering the flow of the flame in the axial direction.

In the gas fuel burner 40 of the second embodiment, the angle $\theta_4$ formed by the third oxidation agent discharge direction $P_4$ and the direction that the center axis $CL_1$ of the burner body 11 extends should be appropriately set in the range of for example equal to or greater than 5° and equal to or less than 30°.

By appropriately setting the angle $\theta_4$ formed by the third oxidation agent discharge direction $P_4$ and the direction that the center axis $CL_1$ of the burner body 11 extends in the range of equal to or greater than 5° and equal to or less than 30°, it is possible to further inhibit spreading of the gas fuel.

Since it thereby becomes possible to inhibit flowing of the flame along the inner wall of the distal end portion 26 (in other words, the side face 13*a* of the combustion chamber 13), it is possible to inhibit damage to the burner body 11.

The gas fuel burner of the second embodiment constituted as above, by having the third oxidation agent discharge port 41 disposed more toward the second circular face 13-2 side than the arrangement position of the second oxidation agent discharge port 19 in the side face 13*a* of the combustion chamber 13, and by setting the angle $\theta_4$ formed by the direction that the center axis $CL_1$ of the burner body 11 extends and the third oxidation agent discharge direction $P_4$ to be smaller than the angle $\theta_3$ formed by the direction that the center axis $CL_1$ of the burner body 11 extends and the second oxidation agent discharge direction $P_3$, since it becomes possible to inhibit flowing of the flame along the inner wall of the distal end portion 26 (in other words, the side face 13*a* of the combustion chamber 13), it is possible to inhibit damage to the burner body 11.

The gas fuel burner 40 of the second embodiment can obtain the same effect as the gas fuel burner 10 of the first embodiment.

In a method for heating with a gas fuel burner that heats an object to be heated using the flame formed by the aforementioned gas fuel burner 40, the object to be heated with the flame may be heated with the flame having the discharge speed of the first oxidation agent discharged to the combustion chamber 13 being in the range of 50 to 300 m/s, the discharge speed of the gas fuel being in the range of 20 to 100 m/s, the discharge speed of the second oxidation agent being in the range of 20 to 80 m/s, and the discharge speed of the third oxidation agent being in the range of 20 to 80 m/s.

By performing the gas fuel burner heating method using such conditions, the mixing of the gas fuel and the second and third oxidation agents is accelerated, and since it is possible to complete the combustion earlier, it is possible to form a short flame with a high temperature.

The flow rate of the first oxidation agent supplied to the first oxidation agent discharge port 17 should be set in a range of 40% to 90% of the total of the flow rates of all the oxidation agents supplied to the combustion chamber 13.

Thereby, it is possible to inhibit damage to the distal end portion of the burner body 11 without separately providing a water cooling mechanism, and it is possible to inhibit oxidation of the object to be heated even when the object to be heated is a material that is easily oxidized.

While preferred embodiments of the present invention have been described in detail, the present invention is not limited the prescribed embodiments, and various transformations and modifications are possible within a range of the gist of the present invention recited within the scope of the claims.

For example, the gas fuel discharge port 18, the second oxidation agent discharge port 19, and the third oxidation agent discharge port 41 may be constituted with one ring-shaped discharge port.

Hereinbelow, test examples 1 to 3 will be described.

TEST EXAMPLE 1

Figure 3:
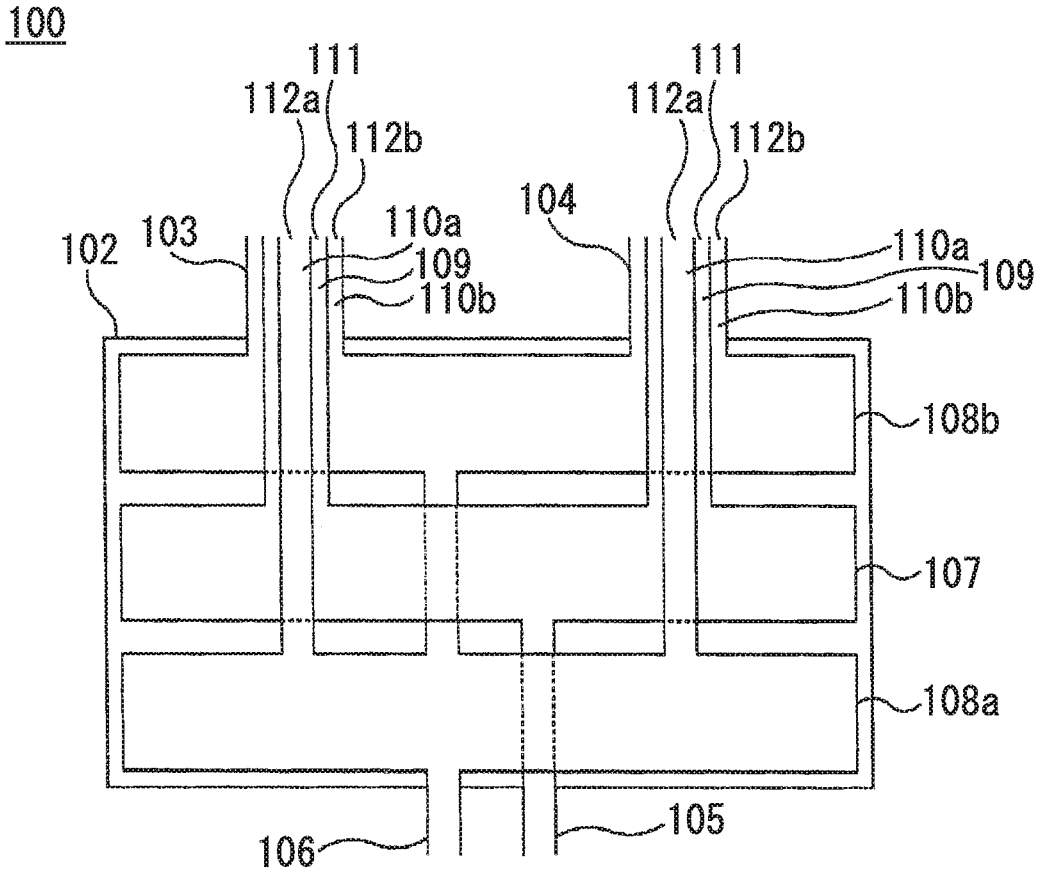
FIG. 3 is a cross-sectional view that shows the outline configuration of the burner disclosed in Patent Document 1.

In test example 1, the heat transfer efficiencies of two burners were evaluated, using the gas fuel burner 10 shown in FIG. 1 as Embodiment 1 and a conventional burner 100 shown in FIG. 3 that is disclosed in Patent Document 1.

The distance between the distal end of each of the two burners and a water-cooled heat transfer surface was set to 150 mm, 200 mm, 300 mm, and 400 mm.

"Heat transfer efficiency" here refers to the value calculated from Equation (1) below, after measuring the flow rate of water flowing to the water-cooled heat transfer surface, the water inlet temperature, and the water outlet temperature and using these values.

$$\text{Heat transfer efficient} = \text{water flow rate} \times (\text{outlet temperature} - \text{inlet temperature}) \times \text{specific heat of water} \div (\text{fuel flow rate} \times \text{low heating value}) \quad (1)$$

FIG. 3 is a cross-sectional view that shows the outline configuration of the burner disclosed in Patent Document 1.

Here, referring to FIG. 3, the constitution of the conventional burner 100 will be described.

The conventional burner is a structure having nozzles 103, 104 (two nozzles). The nozzles 103, 104 each have a fuel introducing portion 109, a first oxygen gas introducing portion 110*a*, a second oxygen gas introducing portion 110, a fuel chamber 107, a first oxygen gas chamber 108*a*, a second oxygen gas chamber 108*b*, a fuel supply pipe 105, and an oxygen gas supply pipe 106.

The first oxygen gas introducing portion 110*a* that is formed cylindrical is disposed in the center of the burner 100, and the fuel introducing portion 109 that is formed cylindrical is disposed on the outside thereof. The second oxygen gas introducing portion 110*b* that is formed cylindrical is disposed on the outside of the fuel introducing portion 109.

The fuel introducing portion 109 is connected with the fuel chamber 107. The first oxygen gas introducing portion 110*a* is connected with the first oxygen gas chamber 108*a*.

The second oxygen gas introducing portion 110*b* is connected with the second oxygen gas chamber 108*b*. The first and second oxygen gas chambers 108*a*, 108*b* are connected via coupling pipes.

The fuel supply pipe 105 is connected with the fuel chamber 107. The oxygen gas supply pipe 106 is connected with the first oxygen gas chamber 108*a*.

A fuel discharge port 111 is disposed at the distal end of the fuel introducing portion 109. A first oxygen gas discharge port 112*a* is disposed at the distal end of the first oxygen gas introducing portion 110*a*. A second oxygen gas discharge port 112*b* is disposed at the distal end of the second oxygen gas introducing portion 110*b*.

The distal end of the fuel discharge port 111, the distal end of the first oxygen gas discharge port 112*a*, and the distal end of the second oxygen gas discharge port 112*b* are arranged on the same plane.

The fuel discharge port 111, the first oxygen gas discharge port 112*a*, and the second oxygen gas discharge port 112*b* are respectively formed into a cylindrical shape and disposed so that their center axes coincide.

The fuel supply pipe 105 is connected with a fuel supply source (not illustrated). The oxygen gas supply pipe 106 is connected with an oxygen gas supply source (not illustrated).

Fuel is supplied via the fuel supply pipe 105 to the fuel chamber 107. The fuel that is supplied to the fuel chamber 107 is supplied to the fuel introducing portion 109 of the nozzles 103, 104, and discharged from the fuel discharge port 111.

Oxygen gas is supplied via the oxygen gas supply pipe 106 to the first oxygen gas chamber 108*a*, and additionally by the coupling pipe, supplied to the second oxygen gas chamber 108*b*.

Oxygen gas from the first oxygen gas chamber 108*a* is discharged from the first oxygen gas discharge port 112*a* via the first oxygen gas introducing portion 110*a* of the nozzles 103, 104.

In addition, oxygen gas from the second oxygen gas chamber 108*b* is discharged from the second oxygen gas discharge port 112*b* via the second oxygen gas introducing portion 110*b* of the nozzles 103, 104.

Here, the conditions of the gas fuel burner 10 of Embodiment 1 will be described referring to FIG. 1.

In Embodiment 1, the diameter $D_1$ of the first circular face 13-1 is 10 mm, the length L of the combustion chamber 13 is 10 mm, the angle $\theta_1$ is 5°, the angle $\theta_2$ is 10°, the angle $\theta_3$ is 15°, the ratio of the first oxygen flow rate to the second oxygen flow rate is 4:1, the discharge rate of the first oxygen (first oxidizing agent) is 300 m/s, the discharge rate of the second oxygen (second oxidizing agent) is 40 m/s, the discharge rate of methane, the gas fuel, is 80 m/s, the total flow rate of the first and second oxygens is 7.7 $Nm^3/h$, and the flow rate of methane, the gas fuel, is 3.5 $Nm^3/h$.

As the conditions of the burner 100 shown in FIG. 3, the following conditions were used.

In the burner 100, the first oxygen discharge speed is 100 m/s, the second oxygen discharge speed is 40 m/s, discharge speed of methane, the gas fuel, is 80 m/s, the total flow rate of the first and second oxygens is 7.7 $Nm^3/h$, and the flow rate of methane, the gas fuel, is 3.5 $Nm^3/h$.

Figure 4:
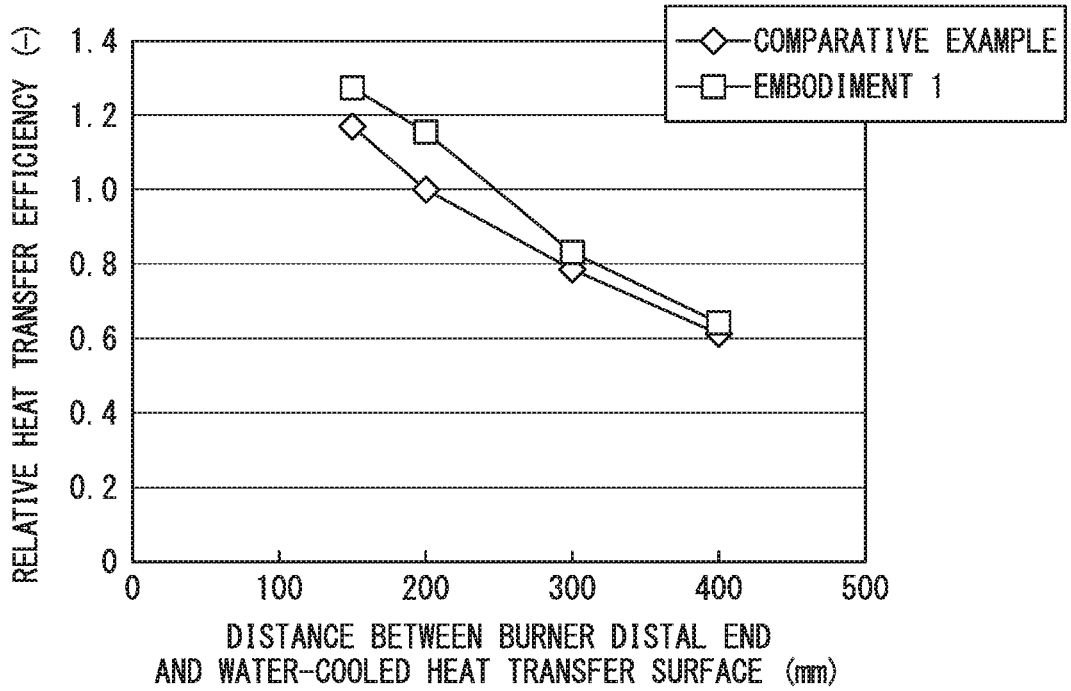
FIG. 4 is a graph that shows the relationship between the distance between the burner of Embodiment 1 and burner of comparative example 1 and a water-cooled heat transfer surface and the relative heat transfer efficiency, according to test example 1.

Using the aforementioned conditions, the relationship between the respective distance between the distal end of the burner of Embodiment 1 and the burner of the comparative example and a water-cooled heat transfer surface, and the relative heat transfer efficiency is shown in FIG. 4.

FIG. 4 is a graph that shows the relationship between the respective distance between the distal end of the burner of Embodiment 1 and the burner of comparative example 1 and a water-cooled heat transfer surface and the relative heat transfer efficiency, according to test example 1. In FIG. 4, the relative heat transfer efficiency is shown assuming the relative heat transfer efficiency for a distance of 200 mm between the distal end of a burner and the water-cooled heat transfer surface to be 1.0.

Referring to FIG. 4, it was confirmed that the heat transfer efficiency of Embodiment 1 is high compared with the comparative embodiment, and in particular, that a high heat transfer efficiency is obtained when the distance between the distal end of the burner and the water-cooled heat transfer surface is 200 mm or less.

Figure 5:
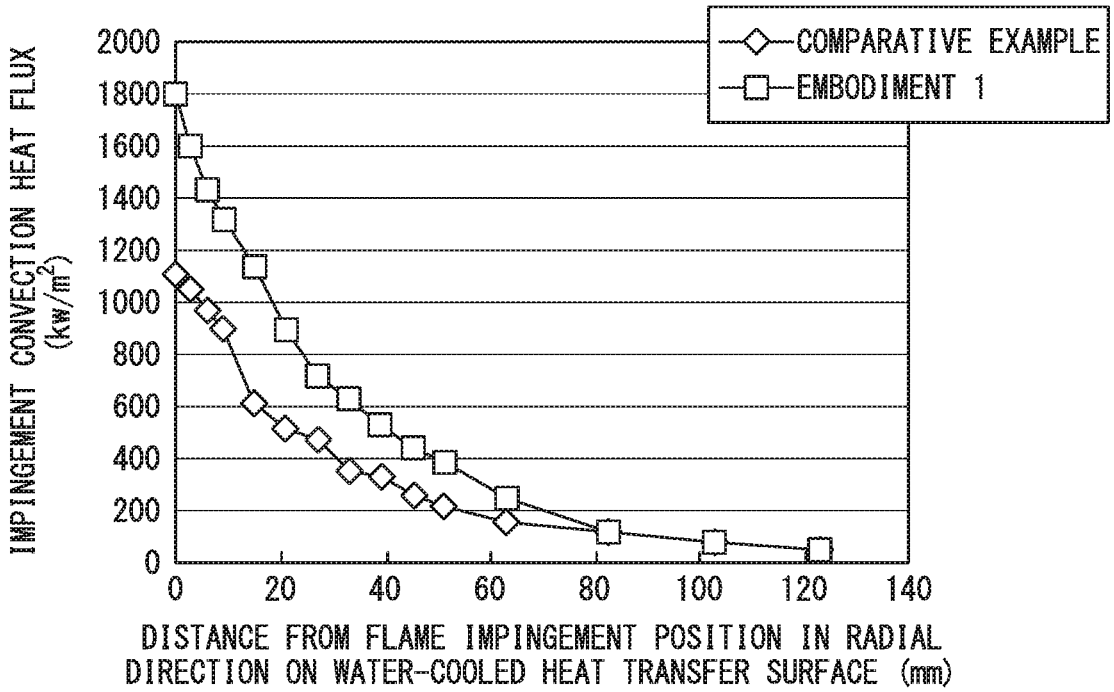
FIG. 5 is a graph that shows the relationship between the distance in the radial direction on the water-cooled heat transfer surface from the flame impingement position and the impingement convection heat flux.

Using the gas fuel burner 10 shown in FIG. 1 and the conventional burner 100 shown in FIG. 3 that is disclosed in Patent Document 1, the relationship between the distance in the radial direction on the water-cooled heat transfer surface from the flame impingement position and the impingement convection heat flux was investigated. FIG. 5 shows the result. FIG. 5 is a graph that shows the relationship between the distance in the radial direction on the water-cooled type heat transfer surface from the flame impingement position and the impingement convection heat flux.

The flame impingement position refers to the point of intersection between the central axis of the burner and the water-cooled type heat transfer surface.

Impingement convection heat flux refers to the quantity of heat transmitted per unit area per unit time. The impingement convection heat flux can be calculated by dividing the amount of heat transmitted to a water-cooled heat transfer surface, which is found from the water quantity of the water-cooled heat transfer surface and the temperature difference between the inlet and outlet thereof, by the surface area of the heat transfer surface.

Based on the result of FIG. 5, in the gas fuel burner of Embodiment 1, it is found that compared with the comparative example, an extremely high heat flux is obtained in the vicinity of the center of the flame impingement position. In particular, at the center position of the flame impingement position, it is possible to obtain heat flux of approximately 1.6 times, and this means it is possible to rapidly heat an object to be heated.

TEST EXAMPLE 2

In test example 2, the same test as Embodiment 1 described above was conducted, using the gas fuel burner shown in FIG. 2 as Embodiment 2.

Specifically, in test example 2, in the case of using the gas fuel burner 40, the heat transfer efficiency was investigated when the distance between the distal end of the burner and the water-cooled heat transfer surface was set to 150 mm, 200 mm, 300 mm, and 400 mm.

Here, the conditions of the gas fuel burner 40 of Embodiment 2 will be described referring to FIG. 2.

In Embodiment 2, except for the angle $\theta_4$ being 10°, ratio of the first oxygen (first oxidizing agent) flow rate to the second oxygen (second oxidizing agent) flow rate to the third oxygen (third oxidizing agent) flow rate being 8:1:1, the discharge rate of the third oxygen being 40 m/s, and the total flow rate of the first to third oxygens being 7.7 $Nm^3/h$, the same conditions as Embodiment 1 were used.

Figure 6:
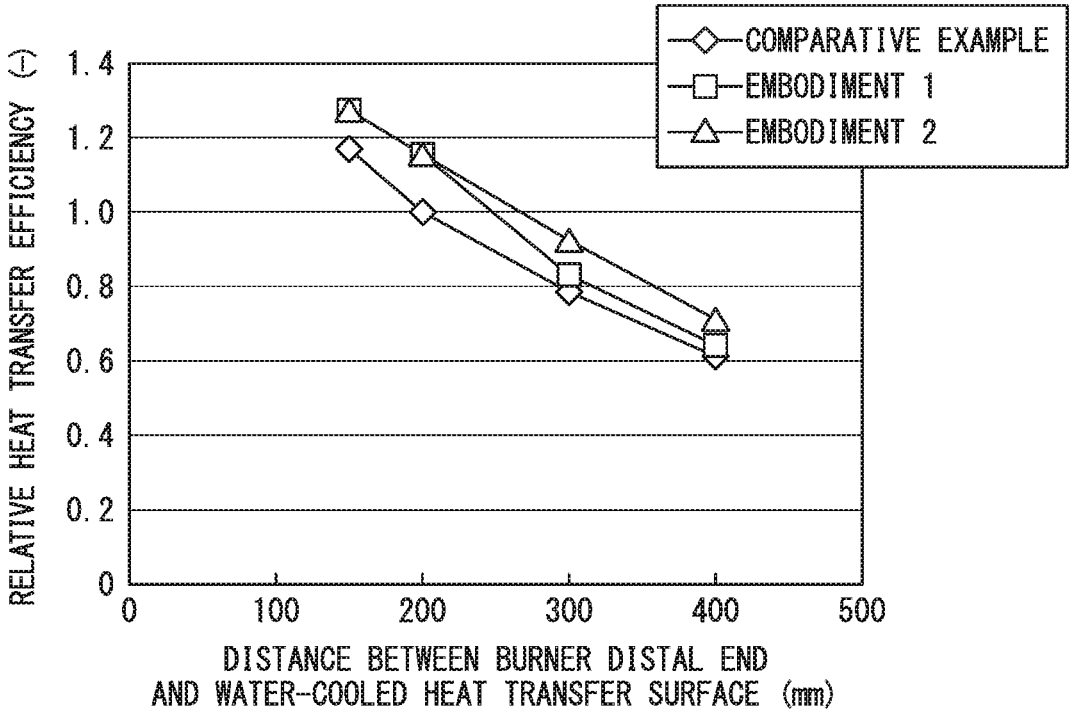
FIG. 6 is a graph that shows the relationship between the distance between the distal end of the burner and the water-cooled heat transfer surface and the relative heat transfer efficiency of embodiments 1, 2 and the comparative example.

Using the aforementioned conditions, FIG. 6 shows the relationship between the distance between the distal end of the burner of the second embodiment and a water-cooled heat transfer surface and the relative heat transfer efficiency calculated by the same method as the calculation method of the relative heat transfer efficiency described in Embodiment 1. FIG. 6 also shows the relationship between the distance between the distal end of the burner of the first embodiment and the comparative embodiment and a water-cooled heat transfer surface and the relative heat transfer efficiency.

FIG. 6 is a graph that shows the relationship between the distance between the distal end of the burner of the first and second embodiments and the comparative embodiment and a water-cooled heat transfer surface and the relative heat transfer efficiency. FIG. 6 shows the relative heat transfer efficiency, assuming the relative heat transfer efficiency for a distance of 200 mm between the distal end of a burner and the water-cooled heat transfer surface to be 1.0.

Based on the result of FIG. 6, with the gas fuel burner of Embodiment 2, it is found that compared with Embodiment 1, a high heat transfer efficiency is obtained at a distance of 250 mm or more. Also, it was confirmed that a high heat transfer efficiency is obtained even at a position separated from the distal end of the burner.

TEST EXAMPLE 3

In test example 3, using the gas fuel burner 40 shown in FIG. 2, the relative heat transfer efficiency was investigated with respect to (first oxygen amount)/(total oxygen amount). At this time, the impingement convection heat transfer efficiency was measured for the case of changing the percentage of the first oxygen flow rate with respect to the total oxygen flow rate. The flow rate obtained by subtracting the first oxygen flow rate from the total oxygen flow rate was supplied as the second oxygen and the third oxygen. The flow rate of the second oxygen and the flow rate of the third oxygen were made the same flow rate. The result is shown in FIG. 7.

Figure 7:
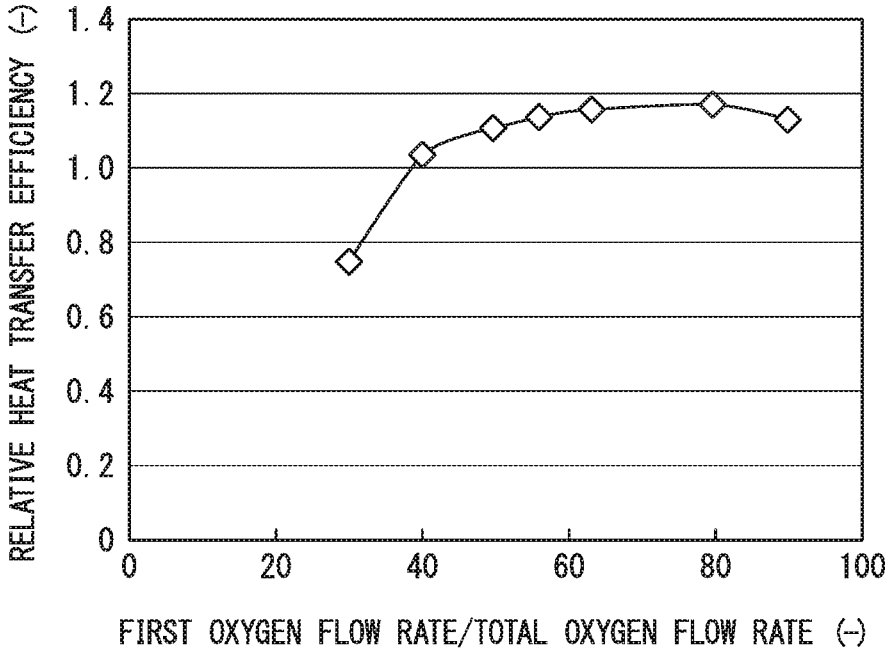
FIG. 7 is a graph that shows the relation between (first oxygen flow rate)/(all oxygen flow rates) and the relative heat transfer efficiency.

FIG. 7 is a graph that shows the relationship between (first oxygen flow rate)/(total oxygen flow rate) and the relative heat transfer efficiency.

Based on the result of FIG. 7, in the gas fuel burner 40 of FIG. 2, it was confirmed that it is possible to obtain a thermal efficiency higher than the comparative example by making the percentage of the first oxygen (first oxidizing agent) 40% or more.

However, when the percentage of the first oxygen (first oxidizing agent) exceeds 90%, the flow rates of the second oxygen (second oxidizing agent) and the third oxygen (third oxidizing agent) become too low, so that a practical flame is no longer obtained. This is considered to be the cause of a reduction in the flame retaining effect and a worsening of fuel-oxidizing agent mixture.

INDUSTRIAL APPLICABILITY

The present invention can be applied to a gas fuel burner suitable for heating an object to be heated by convection heat transfer, and a method for heating with a gas fuel burner.

DESCRIPTION OF THE REFERENCE SYMBOLS

10, 40 gas fuel burner; 11 burner body; 12 gas fuel supply path; 13*a* side face; 13 combustion chamber; 13-1 first circular face; 13-2 second circular face; 17 first oxidation agent discharge port; 18 gas fuel discharge port; 19 second oxidation agent discharge port; 21 first annular member; 22 second annular member; 24 first oxidation agent supply path; 26 distal end portion; 26*a* sloping surface; 28 second oxidation agent supply passage; 41 third oxidation agent discharge port; $C_1$ center; $CL_1$ center axis; d opening diameter; $D_1$ first diameter; $D_2$ second diameter; L length; $P_1$ first oxidation agent discharge direction; $P_2$ gas fuel discharge direction; $P_3$ second oxidation agent discharge direction; $P_4$ third oxidation agent discharge direction; $\theta_1$~$\theta_4$ angles.

The invention claimed is:

1. A non-water cooled gas fuel burner comprising:

a burner body that extends in a predetermined direction, with a flame that heats an object to be heated formed at the distal end thereof;

a combustion chamber that is disposed at the distal end of the burner body and that has a truncated cone shape that expands from the basal end toward the distal end of the burner body wherein the combustion chamber does not include a water cooling mechanism;

a first oxidation agent discharge port that, among first and second circular faces of differing diameters that constitute the combustion chamber, is disposed in the center of the first circular face that is smaller in diameter than the second circular face and that discharges a first oxidation agent in the direction that the center axis of the burner body extends;

a gas fuel discharge port that is disposed on the outside of the first oxidation agent discharge port in the first circular face, and that discharges a gas fuel in a direction intersecting the direction that the center axis of the burner body extends; and a second oxidation agent discharge port that is disposed on a side face of the combustion chamber and that discharges a second oxidation agent in a direction intersecting the direction that the center axis of the burner body extends, wherein the value of a first diameter of the first circular face is made a magnitude within the range of 3 to 6 times the opening diameter of the first oxidation agent discharge port; and the value of the length of the combustion chamber in the direction that the center axis of the burner body extends is within the range of 0.5 to 2 times the first diameter.

2. The non-water cooled gas fuel burner according to claim 1, further comprising a third oxidation agent discharge port that is disposed more on the second circular face-side of the side face of the combustion chamber than the arrangement position of the second oxidation agent discharge port; and that discharges a third oxidation agent in a direction intersecting the direction that the center axis of the burner body extends, wherein, the angle formed by the direction that the center axis of the burner body extends and the discharge direction of the third oxidation agent being smaller than the angle formed by the direction that the center axis of the burner body extends and the discharge direction of the second oxidation agent.

3. The non-water cooled gas fuel burner according to claim 1, wherein, the gas fuel discharge port comprises a plurality of gas fuel discharge holes;

the second oxidation agent discharge port comprises a plurality of oxygen agent discharge holes; and the plurality of gas fuel discharge holes and the plurality of oxygen agent discharge holes are disposed in concentric circles with respect to the center of the first circular face.

4. The non-water cooled gas fuel burner according to claim 2, wherein, the third oxidation agent discharge port comprises a plurality of oxygen agent discharge holes; and the plurality of oxygen agent discharge holes that constitute the third oxidation agent discharge port is disposed in a concentric circle with respect to the center of the first circular face.

5. The non-water cooled gas fuel burner according to claim 1, wherein, the angle formed by the side face of the combustion chamber and the direction that the center axis of the burner body extends is within the range of equal to or greater than 0° and equal to or less than 20°.

6. The non-water cooled gas fuel burner according to claim 1, wherein, the angle formed by the gas fuel discharge direction and the direction that the center axis of the burner body extends is within the range of equal to or greater than 0° and equal to or less than 30°.

7. The non-water cooled gas fuel burner according to claim 1, wherein, the angle formed by the second oxidation agent discharge direction and the direction that the center axis of the burner body extends is within the range of equal to or greater than 10° and equal to or less than 40°.

8. The non-water cooled gas fuel burner according to claim 2, wherein, the angle formed by the third oxidation agent discharge direction and the direction that the center axis of the burner body extends is within the range of equal to or greater than 5° and equal to or less than 30°.

9. A method for heating with a non-water cooled gas fuel burner that heats an object to be heated using the flame formed by the non-water cooled gas fuel burner according to claim 1, the method comprising:

forming the flame with the discharge speed of the first oxidation agent discharged to the combustion chamber being in the range of 50 to 300 m/s, the discharge speed of the gas fuel being in the range of 20 to 100 m/s, and the discharge speed of the second oxidation agent being in the range 20 to 80 m/s; and heating the object to be heated with the flame.

10. The method for heating with a non-water cooled gas fuel burner according to claim 9, wherein, when forming the flame, the discharge speed of the third oxidation agent discharged to the combustion chamber is in the range of 20 to 80 m/s.

11. The method for heating with a non-water cooled gas fuel burner according to claim 9, wherein the flow rate of the first oxidation agent supplied to the first oxygen agent discharge port being in the range of 40% to 90% of the total of the flow rates of all the oxidation agents supplied to the combustion chamber.

12. The non-water cooled gas fuel burner according to claim 3, wherein, the third oxidation agent discharge port comprises a plurality of oxygen agent discharge holes; and the plurality of oxygen agent discharge holes that constitute the third oxidation agent discharge port is disposed in a concentric circle with respect to the center of the first circular face.

13. The non-water cooled gas fuel burner according to claim 2, wherein, the angle formed by the side face of the combustion chamber and the direction that the center axis of the burner body extends is within the range of equal to or greater than 0° and equal to or less than 20°.

14. The non-water cooled gas fuel burner according to claim 3, wherein, the angle formed by the side face of the combustion chamber and the direction that the center axis of the burner body extends is within the range of equal to or greater than 0° and equal to or less than 20°.

15. The non-water cooled gas fuel burner according to claim 4, wherein, the angle formed by the side face of the combustion chamber and the direction that the center axis of the burner body extends is within the range of equal to or greater than 0° and equal to or less than 20°.

16. The non-water cooled gas fuel burner according to claim 2, wherein, the angle formed by the gas fuel discharge direction and the direction that the center axis of the burner body extends is within the range of equal to or greater than 0° and equal to or less than 30°.

17. The non-water cooled gas fuel burner according to claim 3, wherein, the angle formed by the gas fuel discharge direction and the direction that the center axis of the burner body extends is within the range of equal to or greater than 0° and equal to or less than 30°.

18. The non-water cooled gas fuel burner according to claim 4, wherein, the angle formed by the gas fuel discharge direction and the direction that the center axis of the burner body extends is within the range of equal to or greater than 0° and equal to or less than 30°.

19. The non-water cooled gas fuel burner according to claim 2, wherein, the angle formed by the second oxidation agent discharge direction and the direction that the center axis of the burner body extends is within the range of equal to or greater than 10° and equal to or less than 40°.

20. The non-water cooled gas fuel burner according to claim 3, wherein, the angle formed by the second oxidation agent discharge direction and the direction that the center axis of the burner body extends is within the range of equal to or greater than 10° and equal to or less than 40°.

21. The non-water cooled gas fuel burner according to claim 4, wherein, the angle formed by the second oxidation agent discharge direction and the direction that the center axis of the burner body extends is within the range of equal to or greater than 10° and equal to or less than 40°.

22. The non-water cooled gas fuel burner according to claim 3, wherein, the angle formed by the third oxidation agent discharge direction and the direction that the center axis of the burner body extends is within the range of equal to or greater than 5° and equal to or less than 30°.

23. The non-water cooled gas fuel burner according to claim 4, wherein, the angle formed by the third oxidation agent discharge direction and the direction that the center axis of the burner body extends is within the range of equal to or greater than 5° and equal to or less than 30°.

* * * * *